United States Patent [19]

Everett, Jr.

[11] Patent Number: 4,605,326

[45] Date of Patent: Aug. 12, 1986

[54] DOT MATRIX COLOR PRINTER

[75] Inventor: Seth L. Everett, Jr., Lincroft, N.J.

[73] Assignee: The United States of America as represented by the Secretary of the Army, Washington, D.C.

[21] Appl. No.: 714,784

[22] Filed: Mar. 22, 1985

[51] Int. Cl.[4] ..... B41J 27/12; B41J 27/14

[52] U.S. Cl. ..... 400/201; 400/202; 400/205

[58] Field of Search ..... 400/191, 197, 200, 201, 400/202, 124, 205, 205.1, 212, 240.3, 240.4; 101/336

[56] References Cited

U.S. PATENT DOCUMENTS

| | | | |
|---|---|---|---|
| 1,815,026 | 7/1931 | Green | 400/205 X |
| 2,010,137 | 8/1935 | Cargill | 400/205 |
| 3,754,504 | 8/1973 | Clary | 400/201 X |
| 4,009,772 | 3/1977 | Glaser | 400/124 |
| 4,073,371 | 2/1978 | Prager | 400/212 |
| 4,280,767 | 7/1981 | Heath | 400/216.2 |
| 4,336,751 | 6/1982 | Melissa | 101/336 X |
| 4,395,148 | 7/1983 | Gruner et al. | 400/212 |
| 4,426,168 | 1/1984 | Jozuka et al. | 400/224 |

FOREIGN PATENT DOCUMENTS

| | | | |
|---|---|---|---|
| 92088 | 7/1981 | Japan | 400/124 |

OTHER PUBLICATIONS

*IBM Tech. Disc. Bulletin*, by J. H. Meier, vol. 21, No. 11, Apr. 1979, pp. 4448–4451, 400–124.

*Primary Examiner*—Paul T. Sewell

*Attorney, Agent, or Firm*—Anthony T. Lane; Jeremiah G. Murray; Paul A. Fattibene

[57] ABSTRACT

Apparatus for implementing a multi-color printout capability with respect to a dot matrix printer and the like. The apparatus is comprised of an ink reservoir system which includes individual ink reservoirs for replenishing ink of a selected color from a reservoir to individual sections of ink transfer material. The sections are mounted in tandem pairs on elongated ink transfer material holding members which are reciprocally moved linearly back and forth beneath the print head and across the face of a printing medium by a solenoid actuated cam. Each reservoir is continuously in contact with respective section of ink transfer material.

22 Claims, 12 Drawing Figures

FIG. 1
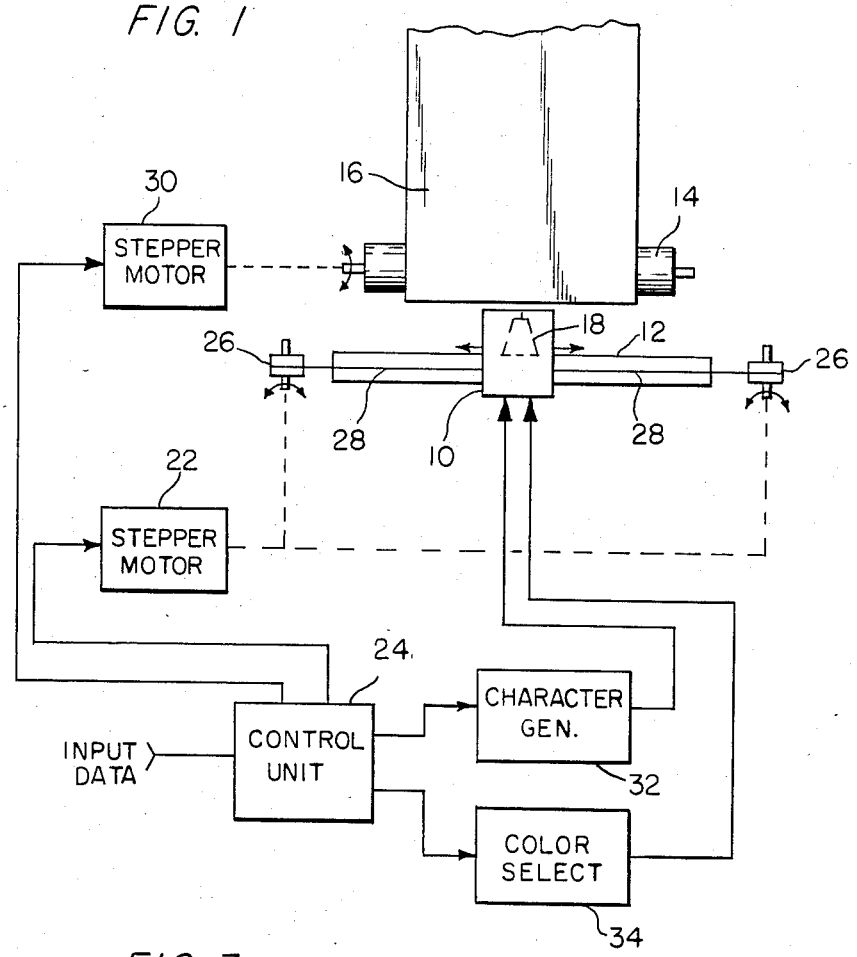
FIG. 2A
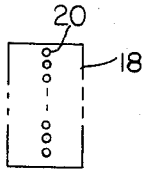
FIG. 2B
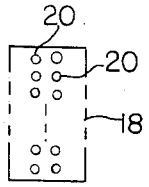
FIG. 3
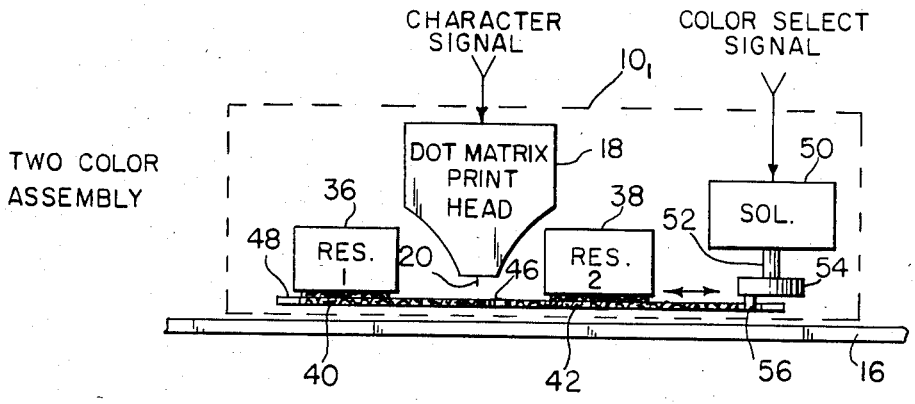
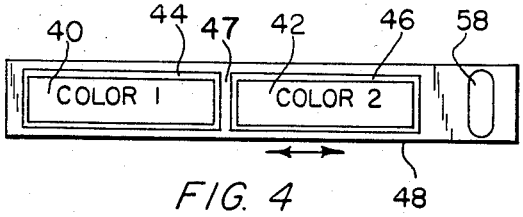
FIG. 4

DOT MATRIX COLOR PRINTER

This invention may be manufactured and used by or for the Government for governmental purposes without the payment of any royalties thereon or therefor.

BACKGROUND OF THE INVENTION

1. Field of the Invention

This invention relates generally to impact moving carriage printers and more particularly to a dot matrix impact printer having a color print capability.

2. Description of the Prior Art

Dot matrix impact moving carriage printers are well known and typically include a print head containing a plurality of solenoid actuated print wires to selectively drive each print wire against an inked ribbon located above the surface of a sheet or web of paper to print a row of dots to form a symbol, an alpha-numeric character or a graphic. The print head is conventionally mounted on a carriage which is adapted to move transversely across the paper while a predetermined number of print wires are selectively driven against the ribbon and paper to generate a selected printed image. While dot matrix printers were first designed to print in only a single color, typically black, more recently a color print capability has been added to such apparatus. Notable examples include U.S. Pat. No. 4,073,371, entitled, "Apparatus And Circuits For Two Color Printing In Electronic Impact Printers", which issued to J. Prager, Feb. 14, 1978; U.S. Pat. No. 4,280,776, entitled, "Printing Apparatus", which issued to J. S. Heath on July 28, 1981; U.S. Pat. No. 4,395,148, entitled, "Positioning Of a Multi-color Ribbon", which issued to M. Gruner, et al. on July 26, 1983; and U.S. Pat. No. 4,426,168, entitled, "Serial Impact Printer For Multi-color Printing", which issued to M. Jozuka, et al. on Jan. 17, 1984. In all of the aforementioned patents, there is provided means for selectively positioning a multi-colored ink ribbon in front of a print head.

Accordingly, it is an object of the present invention to provide an improvement in impact type dot matrix printers.

It is a further object of the invention to provide a dot matrix printer for printing in multiple colors.

Another object of the invention is to provide an impact dot matrix printer which eliminates the conventional inked ribbon and the necessary forward and reverse control mechanisms therefor.

Still another object of the invention is to provide a relatively low cost yet reliable color printer which can operate in harsh environments.

SUMMARY

Briefly, the foregoing and other objects of the invention are provided by apparatus for implementing multicolor printout capability on a dot matrix printer by an ink reservoir system which is comprised of individual ink reservoirs for replenishing ink of a selected color from a reservoir to individual sections of ink transfer material which are mounted in tandem pairs on elongated ink transfer material holding members which are reciprocally moved linearly back and forth across the front, i.e. pin end of the print head and across the face of a printing medium by a solenoid actuated cam. Each reservoir is continuously in contact with a respective section of ink transfer material so that its replacement is only required upon its physical wearout.

BRIEF DESCRIPTION OF THE DRAWINGS

While the present invention is defined in the claims annexed to and forming a part of this specification, a better understanding can be had by reference to the following description when taken in conjunction with the accompanying drawings in which:

FIG. 1 is a block diagram generally illustrative of an impact dot matrix printer in accordance with the subject invention;

FIGS. 2A and 2B are diagrams illustrative of two conventional arrangements of printing wires or pins utilized in a dot matrix print head;

FIG. 3 is a mechanical schematic diagram of a print head assembly incorporating a first embodiment of the invention;

FIG. 4 is a top plan view partially illustrative of the ink transfer material holder subassembly for a two-color print head assembly as shown in FIG. 3;

DESCRIPTION OF THE PREFERRED EMBODIMENTS

Figure 5A:
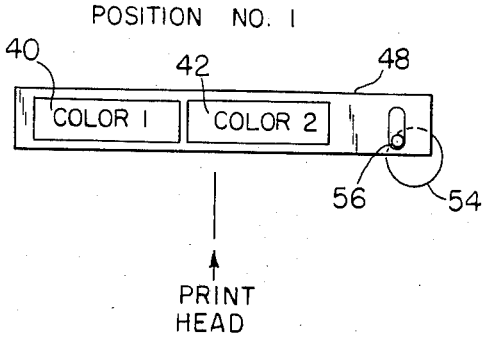
FIGS. 5A and 5B are diagrams illustrative of the manner in which the material holder subassembly shown in FIG. 4 is linearly translated beneath the print head shown in FIG. 3.

Referring now to the drawings wherein like reference numerals refer to like components, FIG. 1 discloses a block diagram of a dot matrix type of impact printer which is comprised of, among other things, a print head assembly 10 which incorporates the features of the invention and which are further disclosed in FIGS. 3 through 10 and which will be considered subsequently. The print head assembly 10, as is well known, is adapted to ride back and forth along the track 12 or some such apparatus which is located in front of a platen or drive roller member 14 containing printing medium 16 consisting of a sheet or web of paper or other printing material and which will be printed with alpha-numeric characters by means of a multi-wire print head 18, having a single or double column of printing pins or wires 20 as shown in FIGS. 2A and 2B.

Travel of the print head assembly 10 across the face of the printing medium 16 is caused by a stepper motor 22 which operates in response to electrical signals from a control unit 24 for driving a pair of sprockets, toothed gears or pulleys 26, one at a time, which operate to move a drive cable or the like 28. Acting in concert with the stepper motor 22 is another stepper motor 30 which is coupled to the platen or drive roller 14 for advancing the printing medium 16. The paper drive stepper motor 30 is also controlled by the control unit 24 which additionally responds to character print input data to control a character generator 32 which has for its purpose operating the dot matrix print head 18 in a conventional fashion to print a predetermined alphanumeric character. Where multi-color printing is desired as in the case of the present invention, the control unit 24 also controls a color select circuit whose purpose is simply to operate one or more electrical solenoids shown in FIGS. 3 and 7 and which will be considered in more detail as the course of the description of the preferred embodiments continues.

Turning now to the implementation of a first embodiment of the invention attention is now directed to FIG. 3 where reference numeral $10_1$ generally denotes a two color print head assembly having an ink reservoir and transfer system which includes two separate ink reservoirs 36 and 38 for colors #1 and #2 which may be, for example, black and red. The reservoirs 36 and 38 are positioned within the print head assembly 10 so as to be in constant contact with respective sections 40 and 42 of ink absorbent transfer material which comprise elongated segments of generally rectangular configuration. The two sections 40 and 42 are aligned in end to end relationship but mutually separated from each other on rectangular apertures 44 and 46 of a generally rectangular elongated thin plate member 48 which is positioned in front of the nose portion of the print head 18 containing the print wires 20 and transversely across the sheet or web of printing material 16. The member 48 constitutes a holder of the ink transfer material and is translated linearly back and forth in front of the print wires 20 so that one or the other of the ink absorbent material sections 40 or 42 is located intermediate the print head 18 and the printing medium 16. Ink is continuously supplied from the respective ink reservoirs 36 and 38 to the respective sections of transfer material 40 and 42 via osmosis.

Figure 5B:
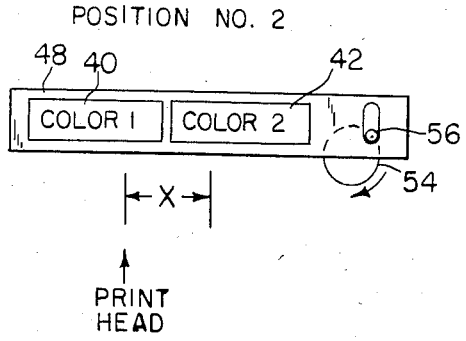
Figure 6:
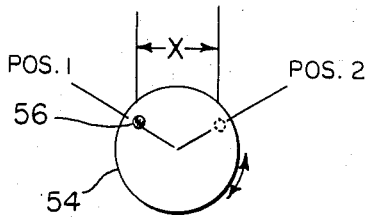
FIG. 6 is a diagram illustrative of the cam action effected by the solenoid shown in FIG. 3.

Placement of a selected color ink transfer material between the print wire location and the printing material 16 is accomplished by a two position rotary solenoid 50 whose armature 52 is coupled to a circular cam 54 having an outwardly projecting element 56 which is adapted to engage a slot 58 located at one end of the elongated ink transfer material holding member 48 as shown in FIG. 4. This action is furthermore shown in FIGS. 5A and 5B whereupon rotation of the cam 54 as shown in FIG. 6 between positions No. 1 and No. 2 causes a linear translation of the member 48 a distance "X". The unenergized condition of the solenoid 50 which may be, for example, the position No. 1 shown in FIG. 5A, moreover, causes the section 42 of ink transfer material of color #2 to be between the position of the print head 18 and the printing medium 16 (FIG. 1) whereas energization of the solenoid 50 and rotation of the cam 54 causes the section 40 containing the ink transfer material of color #1 to be between the print head 18 and the printing medium 16 as shown in FIG. 5B.

By locating the two sections 40 and 42 of ink transfer material so that the separation distance 47 therebetween is just slightly more than the width of the print wire configuration, as shown in FIGS. 2A and 2B, the translation distance "X" can be made quite small, thus requiring very little cam motion. This is particularly important for high speed, low wear operation.

Insofar as the composition of the ink transfer material is concerned, it must readily absorb ink yet be sufficiently durable to withstand repeated print wire or pin impact. In order to accomplish this function, the material preferably comprises a sandwich of two materials, one of which comprises the absorbent inking material facing the paper and the other a strong backing material known in the art by the trade names "Mylar" or "Kaptan", for example, which faces the print head pins 20.

Figure 7:
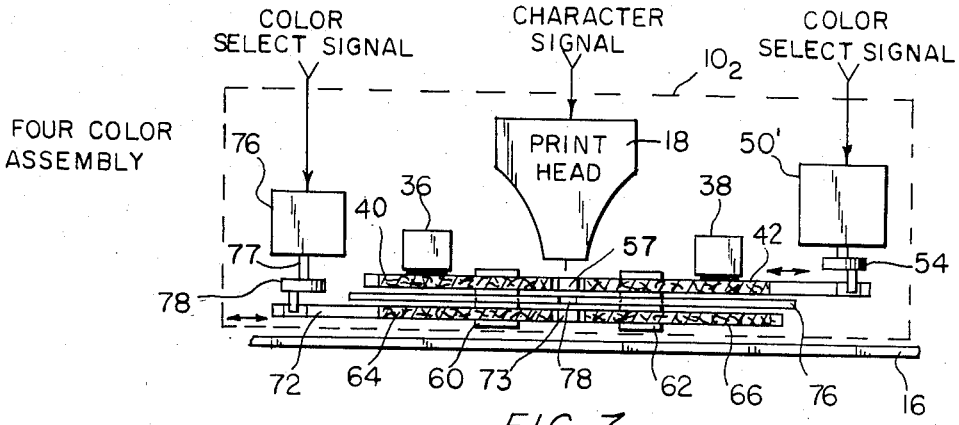
FIG. 7 is a mechanical schematic diagram illustrative of a print head assembly in accordance with a second embodiment of the invention.

Referring now to FIG. 7, disclosed thereat is a print head assembly $10_2$ which comprises a four color assembly and which includes not only the elements substantially as disclosed in the embodiment of FIG. 3, but additionally includes a duplication thereof with a modification of the ink transfer material holding members.

Figure 8:
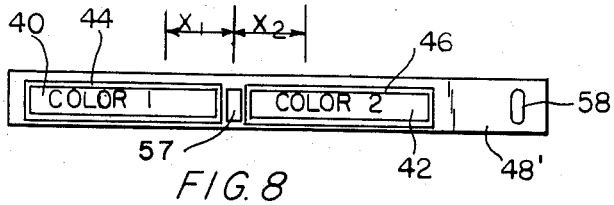
FIG. 8 is a plan view generally illustrative of a portion of the upper ink transfer material holder subassembly of the embodiment shown in FIG. 7.

Referring now to FIG. 7, an upper ink transfer subassembly including the two reservoirs 36 and 38 of FIG. 3 are in contact with respective first and second color ink transfer material sections 40 and 42 located on a modified ink transfer material holder member 48' which is substantially identical with the member 48 shown in FIG. 4 with the exception that now there is provided another aperture 7 located intermediate the two material holding apertures 44 and 46 as shown in FIG. 8. The purpose of this configuration is that the actuating solenoid therefor now comprises a three position rotary solenoid 50' which is operable to operate the cam 54 between three discrete positions. The zero position or unenergized state of the solenoid 50' positions the middle aperture 57 beneath the print head 18 while a first energized position (No. 1) is operable to move the material holding member 48' so that color number #2 ink transfer material 42 is located under the print head 18 while a second energized position (No. 2) is operable to retract the member 48' so that color #1 ink transfer material 40 is under the print head.

Figure 9:
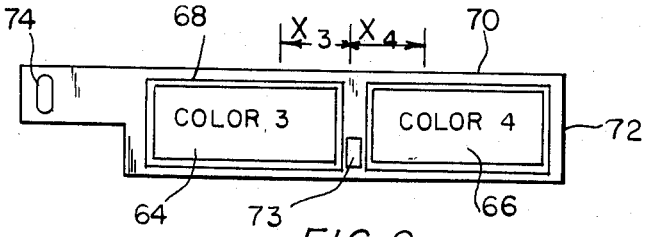
FIG. 9 is a plan view generally illustrative of the lower ink transfer material holder subassembly shown in FIG. 7.
Figure 10:
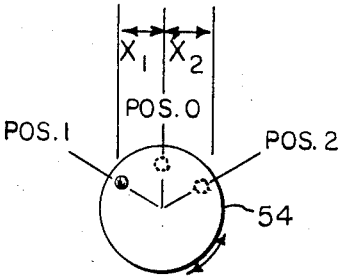
FIG. 10 is a diagram illustrative of the solenoid actuated cam action for the ink transfer subassemblies shown in FIGS. 8 and 9.

Beneath this subassembly is a second ink transfer subassembly which includes a third and a fourth color ink reservoir 60 and 62. These reservoirs are respectively in constant contact with relatively larger sections 64 and 66 of ink transfer material of colors #3 and #4 located on enlarged apertures 68 and 70 of an elongated material holder member 72 similar to member 48' but relatively wider across the body and having a slot 74 located at its opposite end. The member 72 is driven by a second three position rotary solenoid 76 whose armature 77 is coupled to a cam member 78 having a projecting member into the slot 74. The material holder member 72 as shown in FIG. 9 is relatively wider than the member 48' so that the two reservoirs 60 and 62 can be located behind the member 48' and still be in contact with the ink transfer material sections 64 and 66 as shown in FIG. 7. The member 72 is operated by the solenoid 76 in the same manner as the upper member 48'. It also includes an aperture 73 which is in line with the aperture 57 of the member 48' in the unenergized position of solenoid 76. A separating plate 76 is located between the two members 48' and 72 and additionally includes an aperture 78 so that in the unenergized position of both solenoids 50' and 76 the print wire or pins 20 of the print head 18 can hit the printing medium 16 unobstructed. Thus by selective energization of the two solenoids 50' and 76, any one of the four ink transfer material sections 40, 42, 64 and 66 can be brought into registration with the print head 18. When desirable, the relative positions of the ink reservoirs may be reversed.

Furthermore, solenoid control is provided by the color select circuitry 34 shown in FIG. 1 and which may be of any conventional design. For example, control of the solenoids shown in the embodiments of FIGS. 3 and 7 can be designed so that multiple passes on a single character line being printed can achieve several colors on the same line. One typical scheme would be to print a different color on each pass on the same line. By this process, used in concert with conventional dot matrix printer technology, additional colors can be obtained by overprint, close proximity print, or dithering techniques. Furthermore, use of colors such as yellow, cyan and magenta can be blended to produce red, green and blue print, with black being utilized as the fourth color. Even partial mixing of the three colors can be used to create shades of different colors.

The color implementation of the dot matrix print head assembly as disclosed may furthermore be implemented in a cartridge type format so that the entire unit can be easily replaceable. While one type of dot matrix impact type print head has been disclosed, it should be noted that, when desirable, the subject invention can be used with any impact type printer including daisy wheel, rotating balls, and chain type printers.

Having thus shown and described what is at present considered to be the preferred embodiments of the subject invention, it should be understood that the same has been made by way of illustration and not limitation. Accordingly, all modifications, alterations and changes coming within the spirit and scope of the invention are herein meant to be included.

I claim:

1. An impact printer which operates to print in a plurality of colors, on a medium, comprising:

impact print means; means for providing relative movement between said print means and said medium, at least one flat elongated ink trnasfer material holding member located intermediate said print means and said medium; at least two elongated mutually separated sections of ink transfer material of selective colors collinearly arranged along the lengthwise dimension of said holding member and being operable to transfer ink in the form of printed indicia, to said medium upon actuation of said print means;

means in contact with each said section of ink transfer material for continuously replenishing a supply of ink of a selected color to the respective section of ink transfer material; and translating means for translating said ink transfer material holding member linearly back and forth across the front of said print means; said translating means including a cam; and means for rotating said cam to at least two positions, said cam engaging said transfer material holding member causing linear translation of said member.

2. The impact printer as defined by claim 1 wherein said print means includes a dot matrix print head.

3. The impact printer as defined by claim 1 wherein said print means includes a print head having a plurality of selectively actuable print pins.

4. The impact printer as defined by claim 3 wherein said plurality of print pins are arranged in at least one collinear set.

5. The impact printer as defined by claim 3 wherein said sections of ink transfer material include a selected type of ink absorbent material facing said print medium and a selected type of with backing material facing said print pins.

6. The impact printer as defined by claim 5 wherein said ink absorbent material and said backing material are contiguous.

7. The impact printer as defined by claim 3 wherein said sections of ink transfer material have a separation at least equal to the width of one print pin.

8. The impact printer as defined by claim 1 wherein said sections are comprised of generally rectangular sections having a relatively short dimension and a relatively long dimension and wherein said long dimension lies along the lengthwise dimension of said holding member.

9. The impact printer as defined by claim 8 wherein said ink transfer material holding member comprises a thin flat plate including a pair of elongated tandemly separated apertures for locating said sections of ink transfer material therein.

10. The impact printer as defined by claim 1 wherein said ink transfer material holding member comprises a thin flat plate including means at one end for engaging said translating means.

11. The impact printer as defined by claim 10 wherein said cam of said translating means is selectively operable for positioning one of said sections beneath said print means.

12. The impact printer as defined by claim 11 wherein said translating means comprises a rotary solenoid operated cam and wherein said means at one end of said thin flat plate comprises a cam follower in the form of a slot engaging said cam assembly.

13. An impact printer which operates to print in a plurality of colors, on a medium, comprising:

impact print means including a print head having a set of dot matrix print pins;

means for providing relative movement between said print means and said medium;

at least two individually movable flat elongated ink transfer material holding members located, one broad surface over the other broad surface, intermediate said print means and said medium; each of said holding members further including at least two elongated mutually separated sections of ink transfer material of selective colors collinearly arranged along the lengthwise dimension of the respective holding member and being operable to transfer ink in the form of printed indicia to said medium upon action of said print means;

means in contact with each said section of ink transfer material for continuously replenishing a supply of ink of a selected color to the respective section of ink transfer material; and first and second like translating means for respectively translating said ink transfer material holding members linearly back and forth across the front of said print means, said first and second like translating means each including a cam; and means for rotating said cam to at least two positions, said cam engaging said transfer material holding member causing linear translation of said member.

14. The impact printer as defined by claim 13 wherein said sections of ink transfer material include a selected type of ink absorbent material facing said print medium and a selected type of strong backing material facing said print pins.

15. The impact printer as defined by claim 14 wherein said ink absorbent material and said backing material are contiguous.

16. The impact printer as defined by claim 13 wherein said sections of ink transfer material have a separation at least equal to the width of one print pin and wherein said holding members further include an aperture at said separation for the passage of actuated print pins therethrough.

17. The impact printer as defined by claim 13 wherein said sections are comprised of generally rectangular sections having a relatively short dimension and a relatively long dimension and wherein said long dimension lies along the lengthwise dimension of said holding member.

18. The impact printer as defined by claim 17 wherein each said ink transfer material holding member comprises a thin flat plate including a pair of elongated tandemly separated apertures for locating respective sections of ink transfer material therein and further including an aperture intermediate said pair of apertures for permitting the passage of actuated print pins.

19. The impact printer as defined by claim 13 wherein each said ink transfer material holding member comprises a thin flat plate including means at one end for respectively engaging said first and second means for translating said holding members.

20. The impact printer as defined by claim 19 wherein said first and second translating means comprises a respective camming mechanism selectively operable for positioning one of said sections beneath said print means.

21. The impact printer as defined by claim 20 and wherein said means at one end of said thin flat plate comprises a cam follower in the form of a slot.

22. The impact printer as defined by claim 21 and wherein each said translating means comprises a solenoid operated cam mechanically in contact with said cam follower.

* * * * *